US006939034B2

(12) United States Patent
Dubois

(10) Patent No.: US 6,939,034 B2
(45) Date of Patent: Sep. 6, 2005

(54) MECHANISM FOR THE TRANSMISSION OF AXIAL AND ROTATIVE MOVEMENTS BETWEEN TWO OFFSET AXLES

(75) Inventor: Jean-Philippe Dubois, Le Lieu (CH)

(73) Assignee: Dubois & Depraz SA, Le Lieu (CH)

( * ) Notice: Subject to any disclaimer, the term of this patent is extended or adjusted under 35 U.S.C. 154(b) by 541 days.

(21) Appl. No.: 09/805,571

(22) Filed: Mar. 14, 2001

(65) Prior Publication Data

US 2001/0046186 A1 Nov. 29, 2001

(30) Foreign Application Priority Data

Mar. 17, 2000 (EP) ..... 00105689

(51) Int. Cl.[7] ..... G04B 27/02

(52) U.S. Cl. ..... 368/190; 368/196; 368/216; 368/206

(58) Field of Search ..... 368/190, 191–193, 368/216, 76, 146–148, 31, 74, 185, 206–208, 150–151, 196

(56) References Cited

U.S. PATENT DOCUMENTS 234,236 A * 11/1880 Buck ..... 368/216
1,090,390 A * 3/1914 French ..... 368/216
4,059,953 A * 11/1977 Morrison et al. ..... 368/36
4,213,293 A * 7/1980 Mabuchi et al. ..... 368/151
4,363,553 A * 12/1982 Thomi et al. ..... 368/148
4,555,185 A * 11/1985 Vuilleumier ..... 368/190
4,629,331 A * 12/1986 Harle ..... 368/147
4,809,250 A * 2/1989 Meier ..... 368/208
6,409,379 B1 * 6/2002 Gabathuler et al. ..... 368/150
6,499,874 B2 * 12/2002 Graemiger ..... 368/190

FOREIGN PATENT DOCUMENTS

DE 593 654 2/1934
DE 19725 884 12/1998

* cited by examiner

*Primary Examiner*—Kamand Cuneo
*Assistant Examiner*—Jeanne-Marguerite Goodwin
(74) *Attorney, Agent, or Firm*—Young & Thompson

(57) ABSTRACT

The mechanism for transmission of axial and rotative movements between two portions of a stem with offset axes, includes a movable assembly movable axially. The section portion of the stem carries a second pinion and is pivoted on said movable assembly but it is axially secured to, this movable assembly. The first portion of the stem is pivoted on the movable assembly but axially secured to this latter and is secured to a first pinion, one or an uneven number of reverser(s), pivoted on the movable assembly kinematically connects the first pinion to the second pinion.

20 Claims, 2 Drawing Sheets

MECHANISM FOR THE TRANSMISSION OF AXIAL AND ROTATIVE MOVEMENTS BETWEEN TWO OFFSET AXLES

BACKGROUND OF THE INVENTION

The present invention relates to a mechanism for the transmission of axial and rotative movements between two offset axles having particular application in a mechanism for setting and winding a timepiece and more particularly such a mechanism comprising a winding crown actuating a winding and setting stem.

More particularly, the present invention relates to a mechanism whose winding and setting stem is in two axial portions located in parallel planes but offset relative to each other. Such winding and setting mechanisms with a stem in two offset pieces are particularly useful for complicated movements, particularly modular, because in such movements the winding stem is located offset relative to the medial plane of movement which is a drawback from the practical and above all the aesthetic point of view.

DESCRIPTION OF THE RELATED ART

Such a winding and setting device is known from DE 197 25 884, which discloses a winding and setting stem in two portions with axes that are parallel and offset, connected kinematically on the one hand in rotation with a first kinematic connection and on the other hand in translation with a second kinematic connection. The principal drawback of the mechanism described in this document resides in the fact that the first kinematic connection introduces a reversal in the direction of rotation between the first and second portion of the winding and setting stem. This is particularly regrettable for the user during setting, because it takes place in the opposite direction from the usual.

SUMMARY OF THE INVENTION

The present invention has for its object to permit the production of an axial and rotatable movement transmission mechanism between two axles, particularly of a winding setting mechanism comprising a winding stem in two axial portions located in parallel planes kinematically connected in rotation and in translation but which avoids a reversal of the direction of rotation of the two portions of the winding stem.

The present invention has for its object a mechanism for the transmission of axial and rotatable movements between two axles located in parallel planes and particularly a winding and setting mechanism for a timepiece, comprising a winding stem in two axial portions located in parallel planes, these two portions of the winding stem being kinematically connected both for rotation and for translation, and which is distinguished by the characteristics set forth below.

BRIEF DESCRIPTION OF THE DRAWINGS

The accompanying drawings show schematically and by way of example an embodiment of the mechanism for the transmission of axial and rotative movements according to the invention, applied to a winding and setting mechanism of the timepiece.

FIG. 1 is a fragmentary cross-section of a timepiece provided with the winding and setting mechanism according to the invention.

DESCRIPTION OF THE PREFERRED EMBODIMENTS

Figure 1:
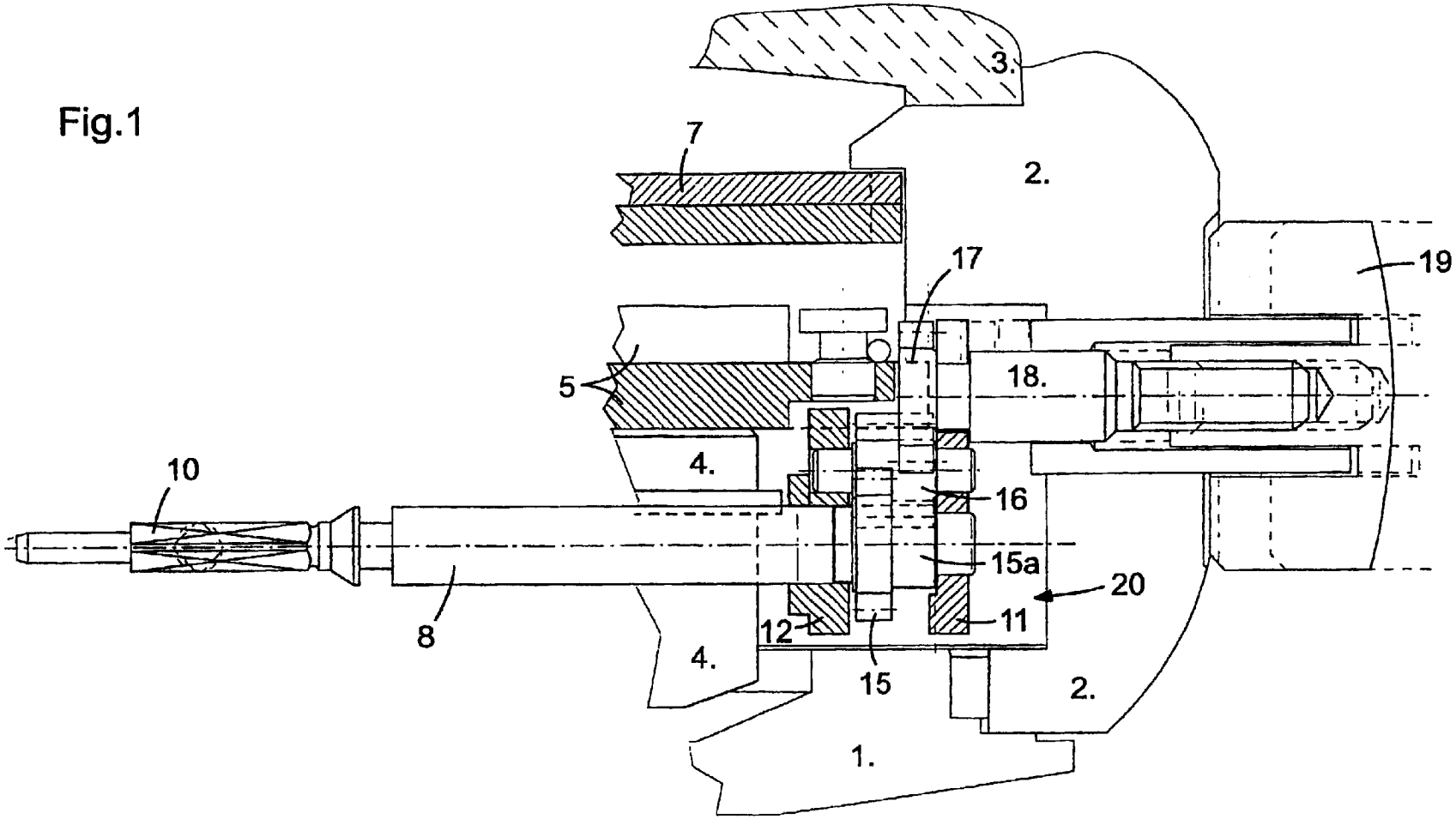
FIG. 1 is an axial cross-section of the mechanism.
Figure 2:
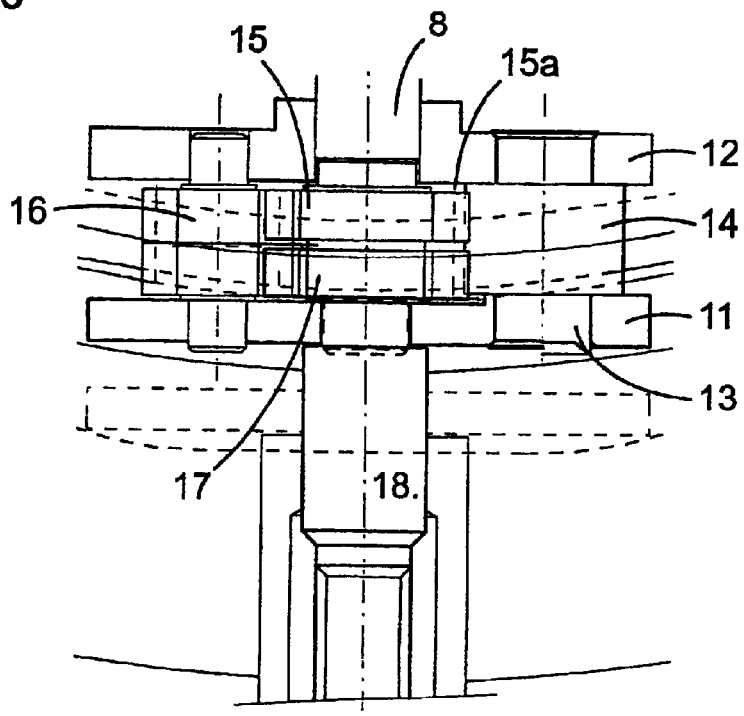
FIG. 2 is a plan view of the mechanism.
Figure 3:
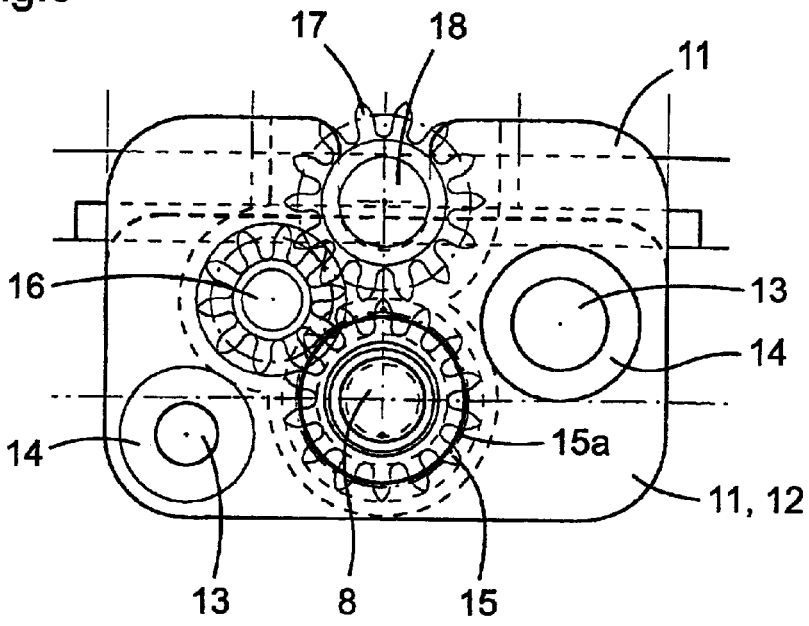
FIG. 3 is an end view of the movable carriage connecting the first and second portions of the winding stem.

The timepiece comprises a casing comprising a back 1, a bezel 2 and a crystal 3, within which is mounted a movement 4 which if desired can be provided with an additional mechanism 5 located between the movement 4 and the dial 7.

As will be seen, the first portion 8 of the winding stem, forming part of the movement 4, is located lower than the medial plane of this timepiece, because of the increased thickness due to the chronograph module 5. The first portion 8 of the winding stem (axle) comprises adjacent its end located in the movement 4, a squared portion (10) permitting winding of the barrel of the movement by a conventional wheel mechanism when this portion 8 of the winding stem is in the winding position shown in FIG. 1. This squared number portion 10 slides in a conventional manner in a movable member actuating a kinematic connection driving in rotation the hands of the movement for setting when this first portion 8 of the winding stem is in the pulled out setting position shown in broken line in FIG. 1.

The free end of this first portion 8 of the winding stem is pivoted in a movable assembly formed by two plates, a front plate 11 and a rear plate 12 fixed together and in parallel planes by rivets 13. The distance between these plates 11 and 12 is determined by cross pieces 14 constituted by the medial portion of the rivets 13 between these two plates 11 and 12.

Mounted rigidly on the end of the first portion 8 of the winding stem and located between the two plates 11 and 12 is a first pinion 15. This first pinion 15 is in engagement with a reverser 16 freely pivoted between the plates 11 and 12. This pinion 15 comprises a hub 15*a* such that the thickness of the pinion 15 and its hub 15*a* occupies all the space comprised between the two plates 11 and 12 of the movable means. The reverser 16 is in engagement with a second pinion 17, also located between the plates 11 and 12 of the movable means, secured to the internal end of the second portion 18 of the winding stem (axle) which is disposed and pivoted in an opening provided in the plate 11 of the movable assembly 11, 12, which opening opens onto the upper section of this plate 11.

The outer end of the second portion 18 of the winding stem passes through the bezel 2 in sealed fashion and terminates in a winding crown 19.

The movable assembly 11, 12 is disposed at least in part in a recess 20 formed radially in the bezel 2. In modifications, this movable assembly could be partially or totally disposed within the movement 4 or its additional mechanism 5. The plate 11 of this movable assembly is gripped without play between the hub of the second pinion 17 and a large diameter portion of the second portion 18 of the winding stem, such that the movable assembly 11, 12 follows the axial movements of this second portion 18 of the winding stem and communicates them to the first portion 8 of the winding stem.

Thus, according to whether the user places the crown in its pushed-in position, shown in FIG. 1 in full lines, or in its pulled-out position, shown in broken lines in FIG. 1, the first portion 8 of this winding stem, parallel but offset, also undergoes axial movements moving it into the winding position, or respectively the setting position, of the movement 4.

When the user rotates the crown 19 and hence the second portion 18 of the winding stem, this rotation is transmitted by the second pinion 17, the reverser 16 and the first pinion 15 to the first portion 8 of the winding stem. Because of the presence of the reverser, the first portion 8 and second portion 18 of the winding stem turn in the same direction.

This winding and setting mechanism permits having the winding stem 19 in the medial plane of the watch case, although the movement 4 is offset relative to this medial plane. Moreover, this mechanism gives rise, during rotation of the winding crown 19, to a rotation in the same direction of the first portion 8 of the winding stem, permitting a setting of the movement in the usual manner which is easy for the user.

This winding and setting mechanism thus comprises a first portion 8 of the winding stem coacting with the movement 4, pivoted in the movable assembly 11, 12, but axially secured to this assembly, as well as a second portion 18 of the winding stem pivoted in the movable assembly 11, 12 but axially secured to this latter. Thus, the two portions 8, 18 of the winding stem are axially secured to each other by means of the movable assembly 11, 12. Moreover, these two portions 8, 18 of the winding stem are connected by the first pinion 15 and second pinion 17 as well as the reverser 16, the first portion 8 of this winding stem thus follows the rotative movements of the second portion 18 of this stem. Thus the two portions 8, 18 of the winding stem are kinematically connected for their movements in translation and rotation and their rotation takes place in the same direction. The kinematic translation connection is carried out by the movable assembly 11, 12; the first pinion 15 and its hub 15*a* and by the second pinion 17 and its hub and the large diameter end of the second portion of the stem 18.

Such a mechanism for transmission of axial and rotative movements between two axles located in two parallel planes can be applied to timepieces having a movement alone, or comprising one or more additional mechanisms, either for winding and seating, or for actuating a calendar or alarm function, etc.

In a modification, the reverser 16 that causes the reversal of the rotative movement such that the two stem portions turn in the same direction, could be replaced by a gear train comprising an uneven number of gears, this might be necessary if the distance separating the two planes in which the two portions of the stem is located, is great.

In a modification, the movable assembly 11, 12 could be made of a single piece produced by machining a single block.

An advantage of the described mechanism further resides in the fact that the stem portion 18 being disposed and pivoted in a recess of the movable assembly, the movement and its additional mechanisms can be removed from the watch case through the back of the case, the back 1 having been removed, without removing the winding stem 18.

In the illustrated embodiment of the transmission mechanism, the two axles are parallel to each other. In a modification, these axles could be located in parallel planes but be angularly offset relative to each other. It suffices thus that the gear train connecting the two portions 8, 18 of the axles comprises conical gears.

The described mechanism can also be used in non-horological applications particularly for transmitting axial and rotative movements between two axles located in parallel planes.

What is claimed is:

1. Mechanism for transmission of axial and rotative movements between first and second offset axles, said mechanism comprising:

a first axle;

a second axle;

an axially movable assembly securing the first and second axles, the first and second axles being pivoted on said axially movable assembly;

a first pinion secured to the first axle;

a second pinion secured to the second axle; and a reverser pivoted on said axially movable assembly kinematically connecting the first pinion to the second pinion, wherein axial movement from the first axle is transmitted to the second axle.

2. Mechanism for the transmission of axial and rotative movements between first and second offset axles, said mechanism comprising:

an axially movable assembly to which are secured the first and second axles, the first and second axles being pivoted on said axially movable assembly;

a first pinion secured to the first axle;

a second pinion secured to the second axle; and one or an odd number of reverser(s) pivoted on said axially movable assembly for kinematically connecting the first pinion to the second pinion.

3. Mechanism of claim 2, wherein, the movable assembly comprises a front plate and a rear plate, the front plate is parallel and secured to the rear plate, and the first pinion, the second pinion, and the reverser are located between the front and rear plates.

4. Mechanism according to claim 3, wherein, the first pinion comprises a hub, and a thickness of the hub occupies all of a distance separating the front and rear plates.

5. Mechanism according to claim 4, wherein, the second axle includes a portion of larger diameter, and the second axle includes a groove located between the portion of larger diameter and the second pinion, the groove having a width corresponding to a thickness of the front plate.

6. Mechanism according to claim 3, wherein, the second axle includes a portion of larger diameter, and the second axle includes a groove located between the portion of larger diameter and the second pinion, the groove having a width corresponding to a thickness of the front plate.

7. Mechanism according to claim 3, wherein, the front plate comprises an opening that opens on an upper portion of the front plate, and the second axle is disposed and pivoted in the opening of the front plate.

8. Mechanism according to claim 2, wherein, the movable assembly moves at least partially in an axial recess of a watch case.

9. Mechanism according to claim 2, wherein, an angle is formed between the first and second axles, and the first pinion, the second pinion, and the reverser are each conical gears.

10. Mechanism according to claim 2, wherein, one of the first and second axles is mounted to a manipulating member mounted on a watch case, and another of the first and second axles is mounted to a timepiece movement disposed within the watch case.

11. Mechanism according to claim 10, wherein, the manipulating member is a winding crown, and the mechanism is a winding and setting mechanism of a watch movement.

12. Mechanism for transmission of axial and rotative movements between two portions of a stem with offset axles, said mechanism comprising:

a first stem portion;

a second stem portion;

an axially movable assembly securing the first and second stem portions, the first and second stem portions being pivoted on said axially movable assembly;

a first pinion carried by the first stem portion;

a second pinion carried by the second stem portion; and an odd number, equal to at least one, of reversers pivoted on said axially movable assembly for kinematically connecting the first pinion to the second pinion, wherein, the movable assembly comprises a front plate secured in parallel to a rear plate, and the first pinion, the second pinion, and the reverser are located between the front and rear plates.

13. Mechanism according to claim 12, wherein, the first pinion comprises a hub, and a thickness of the hub equals a distance separating the front and rear plates.

14. Mechanism according to claim 13, wherein, the second stem portion includes a portion of larger diameter, and the second stem portion includes a groove located between the portion of larger diameter and the second pinion, the groove having a width corresponding to a thickness of the front plate.

15. Mechanism according to claim 12, wherein, the second stem portion includes a portion of larger diameter, and the second stem portion includes a groove located between the portion of larger diameter and the second pinion, the groove having a width corresponding to a thickness of the front plate.

16. Mechanism according to claim 12, wherein, the movable assembly moves at least partially in an axial recess of a watch case.

17. Mechanism according to claim 12, wherein, the front plate comprises an opening that opens on an upper portion of the front plate, and the second stem portion is disposed and pivoted in the opening of the front plate.

18. Mechanism according to claim 12, wherein, an angle is formed between the first and second stem portions, and the first pinion, the second pinion, and the reverser are each conical gears.

19. Mechanism according to claim 12, wherein, one of the first and second stem portions is mounted to a manipulating member mounted on a watch case, and another of the first and second stem portions is mounted to a timepiece movement disposed within the watch case.

20. Mechanism according to claim 19, wherein, the manipulating member is a winding crown, and the mechanism is a winding and setting mechanism of a watch movement.

* * * * *